United States Patent [19]

Yuen

[11] Patent Number: 4,936,462

[45] Date of Patent: Jun. 26, 1990

[54] STORY BOOK FOOD TRAY

[76] Inventor: Frank Yuen, 110-20 71st Ave., Forest Hills, N.Y. 11375

[21] Appl. No.: 413,268

[22] Filed: Sep. 27, 1989

[51] Int. Cl.[5] ..... B65D 81/00

[52] U.S. Cl. ..... 206/542; 206/457; 206/473; 206/475; 206/232; 40/324; 283/100; 446/73

[58] Field of Search ..... 206/542, 457, 472, 473, 206/475, 232, 459; 40/312, 313, 324; 446/304, 73; 283/100; 281/31

[56] References Cited

U.S. PATENT DOCUMENTS

| | | | |
|---|---|---|---|
| 1,143,729 | 6/1915 | Schmidt | 281/31 |
| 1,359,750 | 11/1920 | Schrank | 206/472 |
| 2,162,094 | 6/1939 | Mahone | 206/472 X |
| 2,224,683 | 12/1940 | Ide et al. | 40/324 |
| 2,861,367 | 11/1958 | Chanslor | 40/324 |
| 3,514,887 | 6/1970 | Jacob | 40/324 |
| 3,835,987 | 9/1974 | Growney | 206/457 X |
| 4,369,882 | 11/1983 | Schluger | 206/232 |
| 4,492,306 | 1/1985 | Cooper et al. | 206/232 |
| 4,629,349 | 12/1986 | Pitts | 281/31 |
| 4,712,673 | 12/1987 | Moore | 206/542 X |

*Primary Examiner*—Paul T. Sewell
*Assistant Examiner*—Jacob K. Ackun, Jr.
*Attorney, Agent, or Firm*—Collard, Roe & Galgano

[57] ABSTRACT

The present invention relates to a story book that has two pages, with the first page having the beginning part of a story displayed therein; and with the second page having the ending of the story located beneath a food tray, which when filled with food hides the story but when emptied of food reveals the story or theme ending.

7 Claims, 2 Drawing Sheets

STORY BOOK FOOD TRAY

BACKGROUND OF THE INVENTION

1. Field of the Invention

The present invention relates to a story book that has two pages, with the first page having the beginning part of a story displayed therein; and with the second page having the ending of the story located beneath a food tray, which when filled with food hides the story, but when emptied of food reveals the story ending.

2. The Prior Art

Children between the ages of 1 and 4 years have short attention spans in relation to older children. The process of feeding children in these age groups can at times be difficult because the novelty of meal time is lost over time; and therefore children will focus on other stimuli in their immediate environment.

Attempts have been made in the past to overcome this problem, and prior proposals are as follows.

U.S. Pat. Nos. 4,094,085 and 4,170,303 to Nolan disclose a tray which can be converted into a picture frame apparatus. The tray has various areas which can be used to mount baseball cards after the tray has been used to carry beverages to one's seat, such as at a baseball game. As clearly taught, the tray is designed to provide support for a coffee cup, which support can then be removed to allow the insertion of baseball cards for displaying the same. Nowhere in Nolan is it taught or suggested that a transparent bottom to the tray could be provided to support food so that pictures or text can be placed under the tray and viewed upon removal of the tray contents.

Various other food trays are known, but none of these disclose a tray in which text or pictures were displayed once the contents of the tray are either eaten or otherwise removed. Specifically, Design Patents 197,573 and 251,288 and U.S. Pat. No. 3,094,264 disclose trays having games or other entertaining displays thereon. U.S. Pat. Nos. 1,396,484 and 4,640,033 disclose trays having pictures formed thereon and in the case of the latter patent, have a light within the tray to further enhance the picture displayed. Design Patent 198,387 is a child's feeding dish in which the food receptacles form a smiling face.

However, all of the above references have the disadvantage that none would be able to hold a child's attention during the course of feeding the child a meal.

OBJECTS OF THE INVENTION

It is an object of the present invention to provide a story book food tray that will maintain a child's interest in their food during meal time.

It is another object of the present invention to provide a partitioned food tray which is shaped similar to a storybook and contains a narrative or story beginning on a first page which continues on a second page hidden from view under the filled food tray, until the child eats all the food in the tray to reveal the remainder of the story.

These and further objects of the present invention will become more apparent as the description thereof proceeds.

SUMMARY OF THE INVENTION

The present invention has the following advantages. It becomes possible to maintain a child's interest in their food for the following reasons: to insure that the child's food will remain warm; to keep the process of feeding quick and simple; and to keep meal time novel and to utilize this time in an educational manner. This is based upon utilizing a partitioned food tray which is shaped similar to a storybook and contains a narrative or story that the parent and child can progress through during feeding in an orderly manner which coincides with the sequence of courses during the meal. The invention provides the caretaker of young children with a tool to gain increased child attention during the process of feeding, as well as to provide an additional educational medium. It allows easy compartmentalization of food, stimulates the child to eat in a sequential manner, and rewards the child with a completed story after completion of the meal.

The left-hand side of the story book (inside cover) contains the narrative information which relates directly to a series of food wells on the opposite (right-side) of the book. Key paragraphs and/or pictures in the sequence of the story remain obscured by food until the child eats the contents of the well and uncovers the bottom of the well which is transparent so that material below it can be read there through. As the child continues through the story he/she is required to eat the contents of the subsequent wells to uncover the next paragraph or picture in the story. This construction allows flexibility in that the trays can be made either disposable or re-usable depending upon the replacement of the story text and pictures.

Thus the invention relates to a food tray for encouraging young children to finish their food during meal time. This is accomplished by providing a food tray having food receptacles with clear bottoms. The tray provides for placing a picture story under the tray, with pictures or text under the food receptacles so that the pictures and the story become uncovered as the meal progresses. Thus, as the child eats his way to the bottom of each clear bottom well, the picture story mounted thereunder becomes visible and provides a child with a "reward" for eating his food.

Therefore, the present invention is directed to a story book food tray comprising:

- a first page containing a first means for providing information, and
- a second page having means for holding food, and having a second means for providing information located beneath said food holding means.

The present invention will now be further described by reference to the following drawings, which are not to be deemed limitative of the present invention in any manner thereof.

DETAILED DESCRIPTION OF PREFERRED EMBODIMENTS

Figure 1:
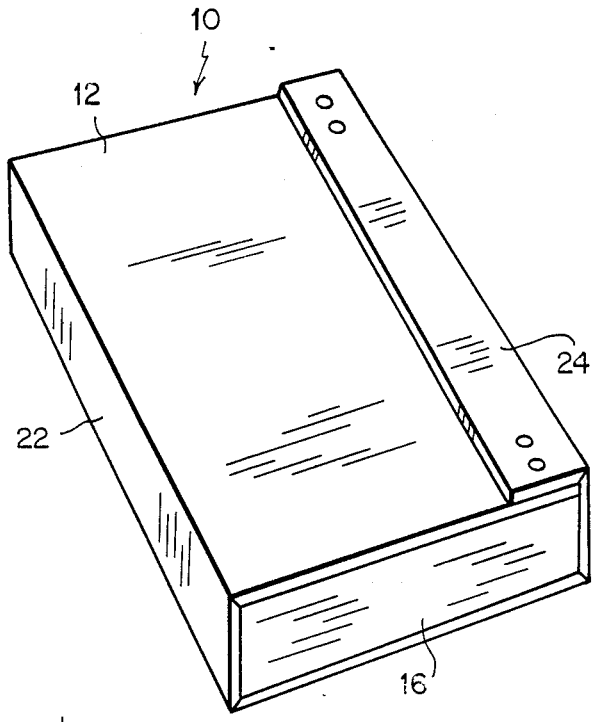
FIG. 1 shows a perspective view of the combination story book and food tray folded together as a closed book.
Figure 6:
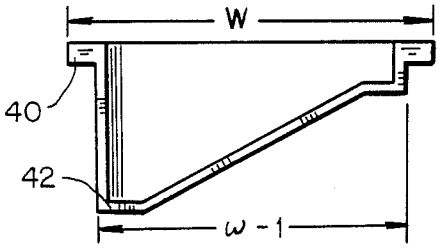
FIG. 6 shows a side view of the food tray of FIG. 4.

FIG. 1 shows a perspective view of the combination story book and food tray 10.

Figure 2:
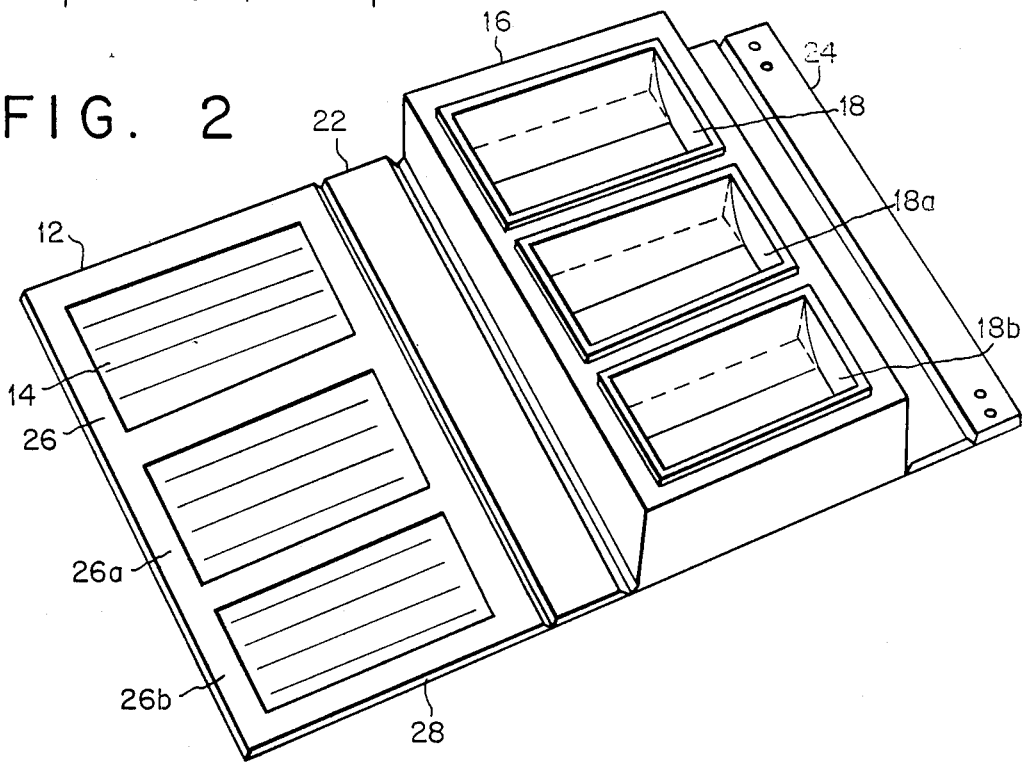
FIG. 2 shows a perspective view of the combination story book food tray laid open so as to display the story page on the left-hand side and the food tray compartment page on the right-hand side.
Figure 4:
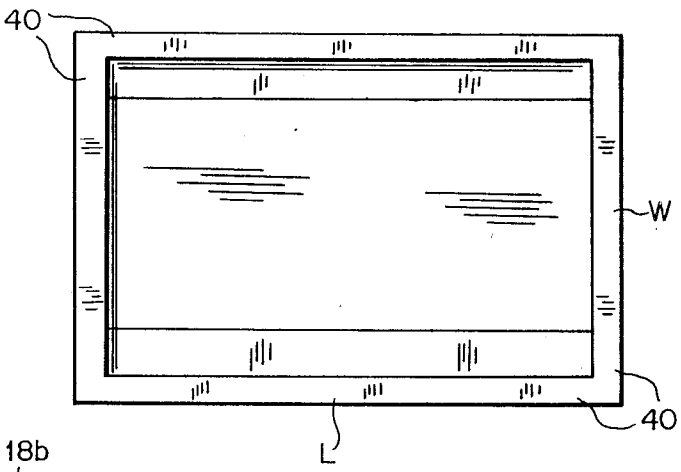
FIG. 4 shows a top view of the food tray of FIG. 3.
Figure 5:
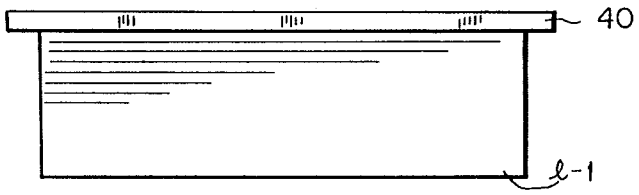
FIG. 5 shows a front view of the food tray of FIG. 4.

FIG. 2 shows a perspective view of the combination story book food tray 10 which has been laid open so as to display the two main pages of the book. The story page 12 is on the left-hand side; and the food tray compartment page 16 is on the right-hand side.

The story book page is the first page 12 which contains a first means 14 for providing information. Means 14 could be made of cardboard or a sheet of plastic material that is flat on both sides and has information thereon, such as printed words and/or pictures, that would be instructive, amusing, attention getting, and educational for small children. In other words the information may be present on both sides of means 14.

Figure 3:
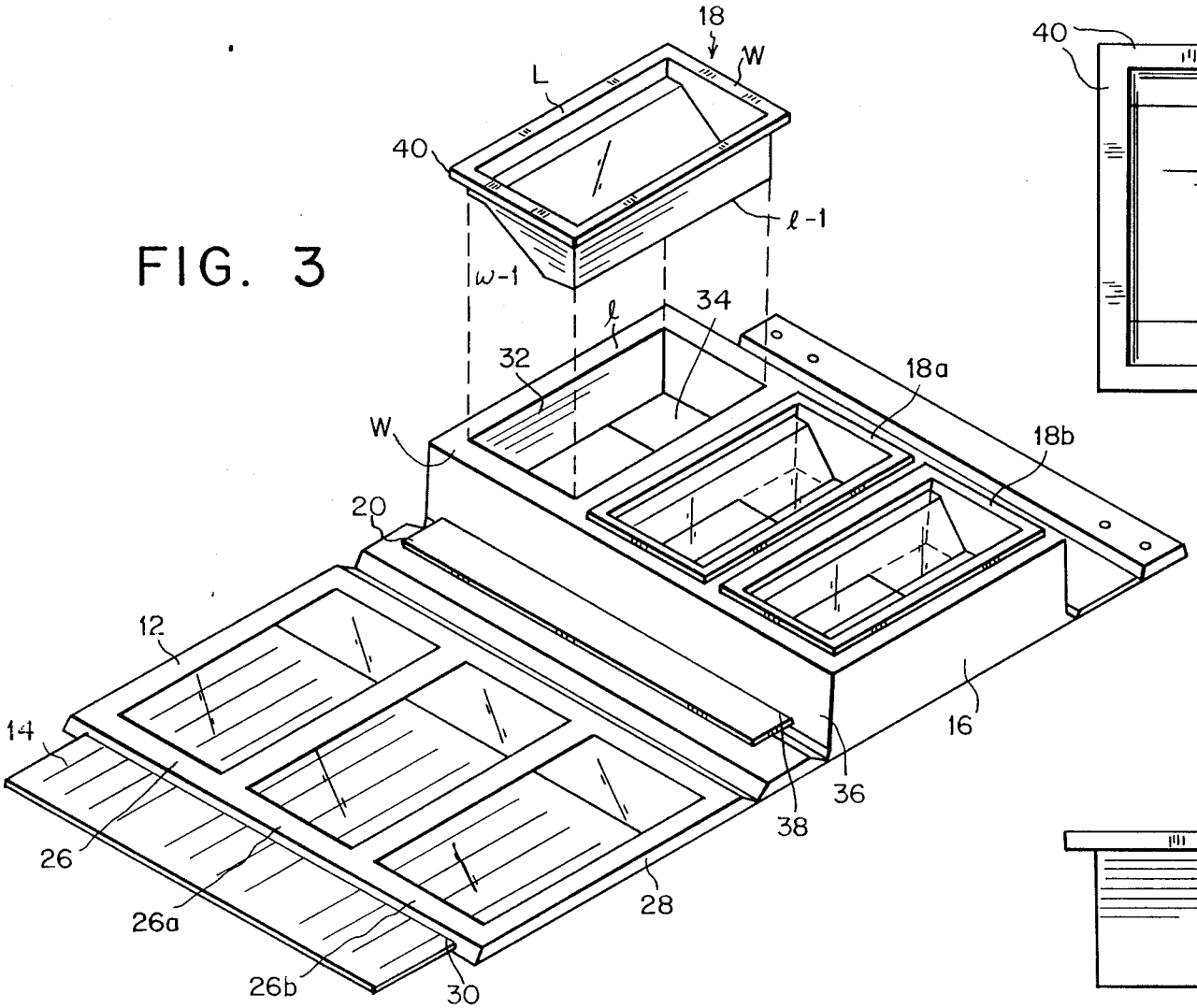
FIG. 3 shows an expanded perspective view of the story book food tray of FIG. 2, and additionally shows how information means can be inserted into the story page and under the food trays, and how a food tray is removable.

The second page 16 has means 18 for holding food, and has a second means 20, which is shown in FIG. 3 for providing information located beneath the food holding means 18. Information providing means 20 could be of the same construction as the first means 14 for providing information, as discussed above.

The food tray story book may be constructed from a sheet of a thermoplastic material which is heated to a temperature suitable for molding such a thermoplastic material into the shape and construction shown in the drawings. The forming of the story book food tray would be carried out using conventional thermoplastic molding machinery and equipment, that are known in the plastic forming art. Suitable examples of plastic materials that can be utilized to manufacture the story book food tray of the invention include polyolefins, such as polyethylene or polypropylene, as well as polyvinylchloride, and also suitable are polyacrylic resins.

The story book food tray also has means 22 for connecting the first page 12 to the second page 16. Therefore, connecting means 22 may be a strip of plastic which has been integrally molded between the plastic sheet which comprises page 12 and the plastic sheet which comprises page 16.

The story book food tray also has means 24 for releasably sealing together the first page 12 and the second page 16 to form the closed book, as shown in FIG. 1. Means 24 is a strip of plastic intricately molded onto the right-side of page 16, as shown in FIG. 2. Means 24 may have fastener means, such as snaps or Velcro fasteners along its edge and which correspond with the same snaps or Velcro mating surfaces as found on page 12 so as to releasably seal together the book.

FIG. 3 shows an expanded perspective view of the story book food tray of FIG. 2, and additionally shows how a first information providing means 14 can be inserted into the story page 12 and how a second information providing means 20 can be inserted under the food tray 18. FIG. 3 also shows how food tray 18 can be removed from page 16.

As can be seen in FIGS. 2 and 3, the first page 12 comprises at least one window 26 for viewing the first means 14 for providing information. There is a first housing 28 beneath the window for holding the first means 14 for providing information, and there is a means 30 (shown in FIG. 3) for providing entry into the first housing 28 or exit out from the first housing for the first means 14 for providing information.

As seen in FIG. 3, the means, located on the second page for holding food, is at least one food container 18 which is releasably fitted into the top portion of a well 32. The food container, when empty, is transparent for viewing through the bottom thereof the second means 20 for providing information. The bottom portion 34 of the well is in effect a second window which provides an unobstructed view of the second means 20 for providing information. There is a second housing 36 beneath the second window 34 for holding the second means 20 for providing information. There is a means 38 for providing entry into the second housing 36 or for providing an exit out from this second housing for the second means 20 for providing information.

As shown in FIGS. 3 through 6, the food container 18 has around its upper edge a perimeter that is comprised by a surrounding flange 40 that goes completely around the upper edge of the food container 18. Flange 40 is of a thickness such that the overall width W of the container is greater than the width w of the well 32, and such that the overall length L of the container 18 is greater than the length l of the well. As more particularly shown in FIG. 6, the food container 18 has a flat bottomed V-shaped lower portion 42 integrally attached beneath the upper edge perimeter flange 40. The lower portion 42 of container 18 has a width w-1 which is lesser than the width w of the well and also has a length l-1 which is lesser than the length l of the well 32. Thus the food container lower portion 42 can fit down into the well to a depth, the extent of which is limited by the juxtaposition of the upper edge perimeter 40 contacting the top edge of the well.

The story book food tray of the present invention would be utilized as follows. The story book would be opened and laid out flat, such that the left-hand page would be exposed and the card, containing the information which the parent wanted the child to begin reading, would be placed into the housing 28 through opening 30. The first food tray would be taken out of the second page on the right-hand side of the book and cleaned, if necessary, and then have a first food selected by the parent placed therein. Then the second information card would be inserted into the second housing 36 through the second opening 38 so as to reside below the food container 18 in the first well 32. FIGS. 2 and 3 illustrate the preferred embodiment which has three windows 26, 26*a* and 26*b* through which three different parts of a story, or three separate stories, or three separate types of information can be displayed. In addition, the second page of the book 16 on the right-hand side has provided wells for three separately positioned food containers. Thus it is possible to have each of three separate stories continue over from the left-hand page to the right-hand page beneath each respective food tray 18. It is also possible to have the same story for the child beginning at the window on the top of page 12 with the story then proceeding next to the window under tray 18, then have the story next continuing with information under window 26*a*. The story would then continue through the window under food container 18*a*. The last part of the story would then be readable and observable through window 26*b* and would finally be completed through the window under container 18*b*. In order for the child to advance to the next part of the story, it would be necessary for the child to consume all of the food in each of the trays, 18, 18*a*, and 18*b*, so that after the meal has been completed, simultaneously the last part of the story would be observable to the child.

Other modifications will be apparent to those skilled in the art. For example it is possible that a story may also be an organized sequence of graphic images or other types of stimuli, such as buzzers or lights. Children in the youngest age group, or elderly patients, or severely retarded children and adults, might not respond to a narrative only. Another embodiment of the invention might include companion accessories, like audio tapes or tape player that would be thematic. It is also possible that the tray is useful for individuals with special problems or handicaps, such as adolescent or adult, to insure that food will remain warm, it is also possible that food trays could also serve as a reservoir for hot or cold water.

While the present invention has been illustrated by reference to a few embodiments, it is not intended that the present invention be so limited; instead the present invention is only to be defined by the scope of the following claims.

What is claimed is:

1. A story book food tray comprising:

a first page containing a first means for providing information;

a second page having means for holding food, and having a second means for providing information located beneath said food holding means;

said food holding means comprising at least one food container releasably fitted into the top portion of a well; said food container when empty being transparent for viewing said second means for providing information; and wherein the bottom portion of said well is a second window for viewing said second means for providing information.

2. The food tray of claim 1, further comprising means for connecting said first page to said second page.

3. The food tray of claim 1, further comprising means for releasably sealing together said first page and said second page to form a closed book.

4. The food tray of claim 1, wherein said first page comprises at least one window for viewing said first means for providing information, a first housing beneath said window for holding said first means for providing information; and means for providing entry into said first housing, or exit out from said first housing for said first means for providing information.

5. The food tray of claim 1, wherein said second page further comprises:

a second housing beneath said second window for holding said second means for providing information; and means for providing entry into said second housing, or exit out from said second housing for said second means for providing information.

6. The food tray of claim 1, wherein said food container comprises an upper edge perimeter surrounding flange that is of a thickness such that the overall width of the container is greater than the width of the well and such that the overall length of the container is greater than the length of the well.

7. The food tray of claim 6, wherein said food container has a flat-bottomed V-shaped lower portion integrally attached beneath said upper edge perimeter, said lower portion being of a width lesser than the width of said well and being of a length lesser than the length of said well;

such that said food container lower portion can fit down into said well to a depth, the extent of which is limited by the juxtaposition of said upper edge perimeter contacting the top edge of said well.

* * * * *